12/9/86 XR 4,628,299 30-29

United States Patent [19]

Tate et al.

[11] Patent Number: 4,628,299

[45] Date of Patent: Dec. 9, 1986

[54] SEISMIC WARNING SYSTEM USING RF ENERGY MONITOR

[75] Inventors: Joseph B. Tate, Sausalito; David E. Brown, Mill Valley, both of Calif.

[73] Assignee: David Pressman, San Francisco, Calif. ; a part interest

[21] Appl. No.: 695,632

[22] Filed: Jan. 28, 1985

[51] Int. Cl.[4] ..... G08B 21/00

[52] U.S. Cl. ..... 340/540; 340/600; 340/690

[58] Field of Search ..... 340/540, 600, 690

[56] References Cited

U.S. PATENT DOCUMENTS 4,214,238 7/1980 Adams et al. ..... 340/540

4,364,033 12/1982 Tsay ..... 340/540

*Primary Examiner*—Glen R. Swann, III

*Attorney, Agent, or Firm*—David Pressman

[57] ABSTRACT

The ambient broadband radio frequency field strength from broadcast stations is monitored (FIG. 4) by periodic sampling (50, 52). A warning indication is provided if the field strength drops significantly. Drops in such field strength have been correlated empirically with the occurrence of seismic activity, usually several days later. Thus the indication serves as an early warning of an impending earthquake. In one preferred embodiment, a broadband, horizontal, very long monopole antenna (40) was connected to a rectifying and smoothing circuit (FIG. 3) to provide a dc output proportional to the ambient rf field. This voltage is digitized (50), and using a suitably-programmed computer (52), the digital version of the field strength signal is sampled once per minute (78). A cumulative or running average of the minute samples is calculated (80) and held. Once per hour the latest running average is stored (84) and a standard deviation (SD) of the last 24 hourly stored running averages is calculated (88). If the SD exceeds a predetermined value, 0.3 in one embodiment, an alarm is triggered (92). The use of the SD eliminates the effect of day-to-day changes in the amounts of the variations of the ambient field strength, due to changes in tides and other factors. Once per day the samples are written (96) to a permanent storage file and a continuous plot of the field strength is also made (14). Preferably the alarm is triggered only if another detector also provides an indication (FIG. 6), thereby to eliminate the effect of machine error.

20 Claims, 6 Drawing Figures

Ambient RF Level vs Time from Before to Occurrence of Quake

SEISMIC WARNING SYSTEM USING RF ENERGY MONITOR

BACKGROUND—FIELD OF INVENTION

This invention relates to the prediction of the fugure occurrence of seismic activity, particularly to the advance notification of earthquakes through the monitoring of ambient radio frequency (rf) energy.

BACKGROUND—DESCRIPTION OF PRIOR ART

Heretofore, insofar as we are aware, seismology, the science of earthquakes, has not been able to make any near-term predictions of earthquakes.

While scientists have known that certain animals may have had some sort of advance knowledge of quakes, due to the fact that they exhibited peculiar behavior before quakes, and not at other times, this behavior has not been consistent and reliable enough to be of practical use.

Also, while scientists have also been able to predict thunderstorms in advance by monitoring the ambient electrostatic field (see, e.g., U.S. Pat. No. 3,611,365 to Husbyorg and Scuka, 1968; 3,790,884 to Kohl, 1974; and 4,095,221 to Slocum, 1978), they have not been aware of any corresponding system for earthquake prediction.

Scientists have been able actually to detect earthquakes during their occurrence by monitoring air pressure variations (e.g., as described in U.S. Pat. No. 4,126,203 to Miller, 1978) and by monitoring the earth's physical movement by seismographs but, again, science has not been aware of any system for short-term advance detection or prediction of quakes.

Due to the devastating effects of quakes to property, life, and limb, public and governmental authorities would derive great benefit from any system which could provide short-time advance notification of great earthquakes. As it is now, except for aftershocks, which seismologists know will occur after any large quake, all great and small quakes occur without warning. Because people in the vicinity of such quakes are unprepared, they often are in places of great vulnerability, such as beside or inside collapsible buildings, so that severe and human injury usually occurs during a quake. Also, property itself is left vulnerable, e.g., by leaving automobiles in or near collapsible buildings, leaving gas and electricity connected such that disruption of these facilities causes fires, and leaving other valuable property in vulnerable areas. If advance notification of a large quake could be provided to the public and civil authorities, people and valuable property could be evacuated and protected, thereby preventing deaths, injuries, and greatly reducing property damage. Further, advance notification of quakes would eliminate the severe psychological trauma which often affects large segments of the populace due to the surprise occurrence of quakes.

OBJECTS AND ADVANTAGES

Accordingly several objects and advantages of the invention are to provide a reliable and effective method of earthquake prediction, to provide a method of preventing death, injuries, and reducing property damage in earthquakes, and to provide a method of reducing the psychological trauma which often accompanies quakes due to their surprise occurrence. Additional objects are to provide such a system which is easy to use, economical, reliable, and portable. Further objects will become apparent from a consideration of the ensuing description, taken in conjunction with the accompanying drawings.

BACKGROUND—THEORY OF INVENTION

The following is a discussion of the background theory of the invention. While we believe it to be technically accurate, we do not wish to be limited by this theory since the operability of the invention has been empirically verified, as will be apparent from the later discussion.

We have recently worked work with the reception and utilization of broadband radio-frequency reception, e.g., for low-power utilization applications, as discussed in the copending application Ser. No. 06/539,223 of Joseph B. Tate, filed Oct. 6, 1983. While doing this work, we have noted that the antenna's output voltage fluctuated with time due to certain, known causes.

First, we noted that the higher we placed an antenna above the ground, the the greater the output signal it provided. We have observed this by raising the physical height of an antenna and observing an increase in power output, and also by observing variations in the output of a fixed antenna near a body of ocean water as a function of the tides: the antenna's output was greatest at low tide and lowest at high tide. We believe that the the change in water level, which serves as a ground plane, effectively lowers or raises the height of the antenna above the ground.

We also noted that the antenna's output was affected by solar flares to a limited extent; these caused the antenna to produce a higher output voltage during their occurrence. We believe this phenomena is caused by an increase in the level of ambient ionization due to the flares.

Further, we noted that the antenna's output dropped at certain irregular times; at first we would not attribute any cause to these drops. However investigation enabled us to correlate these drops with the subsequent occurrence of seismic activity. We found that the magnitude of the drop was proportional to the size of the subsequent earthquake.

Certain phenomena have been discovered to precede earthquakes. These include an anomalous uplift of the ground, changes in the electrical conductivity of rock, changes in the isotopic composition of deep well water, changes in the nature of small earthquake activity (e.g., bunching of small foreshocks), anomalous ground tilt or strain changes, changes in physical properties, such as porosity, electrical conductivity, and elastic velocity in the hypocentral region. Earthquake, McGraw-Hill Encyclopedia of Science And Technology, 1960; Earth by F. Press, W. H. Freeman & Co., 1974.

Phenomena associated with rocks have attracted much recent attention. Wm. Brace of the Mass. Inst. of Technology has found that when rocks were squeezed or compressed, just before they fractured, they tended to develop hairline cracks, swell or dilate (dilatancy), become more porous and electrically conductive, and transmitted high frequency seismic-like waves more slowly. Two of Brace's former students, Amos Nur of Stanford University and Christopher Scholz of Lamont-Doherty furthered Brace's work, connecting the dilatancy theory with seismic P-wave velocity shifts and rock resistivity changes as a precursor for earthquakes. See. e.g., Brace, Orange, and Madden, J. Geophys Res., 70(22), 5669, 1965; A. Nur, Bull. Seis. Soc. of Amer., V 62, Nr. 5, pp. 1217–1222, 1972 Oct.; Earthquake by B. Walker, Time-Life Books, 1982.

Based upon the above background, we have developed a theory as to the cause of this drop in antenna output as a precursor or predictor of earthquakes. We believe that before a quake occurrs, the pressure within underground rock bodies temporarily increases greatly, causing the rocks to dilate and become conductive, in accordance with the works of Brace, Nur, and Scholz. This increase in conductivity effectively raises the ground plane, thereby causing the antenna's output to decrease temporarily.

Thus before the occurrence of a quake, the underground pressure increases greatly temporarily, causing underground rock bodies to swell and become more conductive, thereby raising the ground plane, which in turn causes the voltaic output of nearby antennas to drop.

We accordingly constructed an apparatus to automatically monitor antenna output and provide a suitable indication if the output level dropped significantly. The indication was calibrated empirically after much experimentation so as to filter ouo the effects of solar- and tide-caused variations. We did this by arranging the apparatus so that an output indication was provided only if the antenna output dropped a predetermined degree beyond its average level; we utilized statistical filtering techniques to accomplish this.

DRAWINGS

FIG. 1—SEISMIC EARLY WARNING APPARATUS

Figure 1:
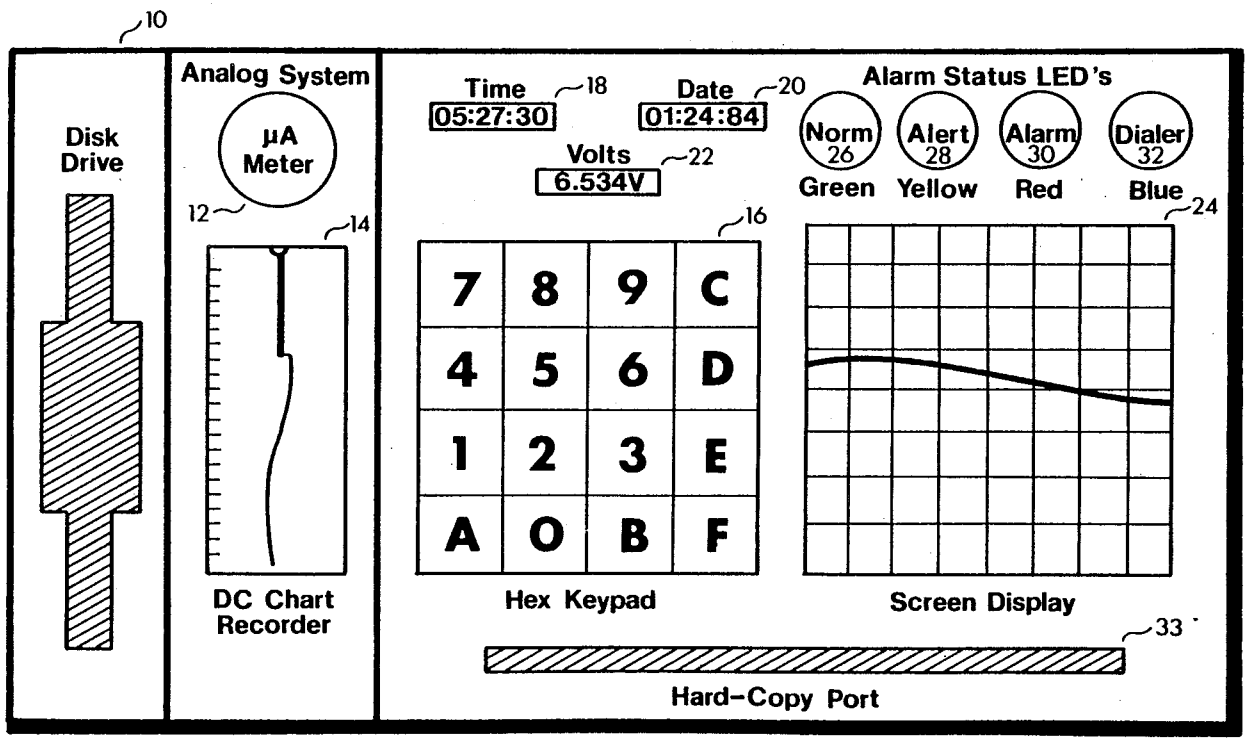
FIG. 1 shows the front panel of a Seismic Early Warning (SEW) apparatus according to the invention.

In accordance with the invention, a seismic early warning apparatus is provided as shown in FIG. 1. The apparatus consists of a housing containing a general purpose computer (not shown), a disc drive 10, an analog system comprising a microampere meter 12 arranged to monitor direct current (which is proportional to the ambient rf energy), and a direct current strip chart recorder 14 arranged to provide a continuous indication of the current antenna output, which will be called the ambient power level. A hexidecimal keypad 16 is provided to enter data, such as time, for entering programs and changes and for operating the system according to preset codes. The time, date, and voltaic level of the antenna's output are continuously indicated by digital readouts 18, 20, and 22, respectively. A screen display 24 is provided to display graphic and alphanumeric information of the current status of the apparatus and previous data records.

Lastly the apparatus includes four status indicating lamps, which preferably are LEDs (light-emitting diodes) as follows: A green LED 26 indicates that the system is on and functioning normally. A yellow LED 28 indicates that the system has detected an event, namely the occurrence of a drop in ambient power below the preset level, which would be the prediction of an impending earthquake. A red LED 30 is provided as backup confirmation of the occurrence of the event; LED 30 is illuminated when a duplicate receiving system also detects an event. A blue LED 32 indicates initiation of operation of an automatic telephone dialer within the system, which has been preprogrammed to dial a predetermined number and provide a warning in the event of an occurrence of an alarm condition. Lastly the apparatus includes a hard copy output port 33 for providing printed graphic and numeric outputs of all system data.

FIG. 2—AMBIENT RF LEVEL V. TIME BEFORE QUAKE

Figure 2:
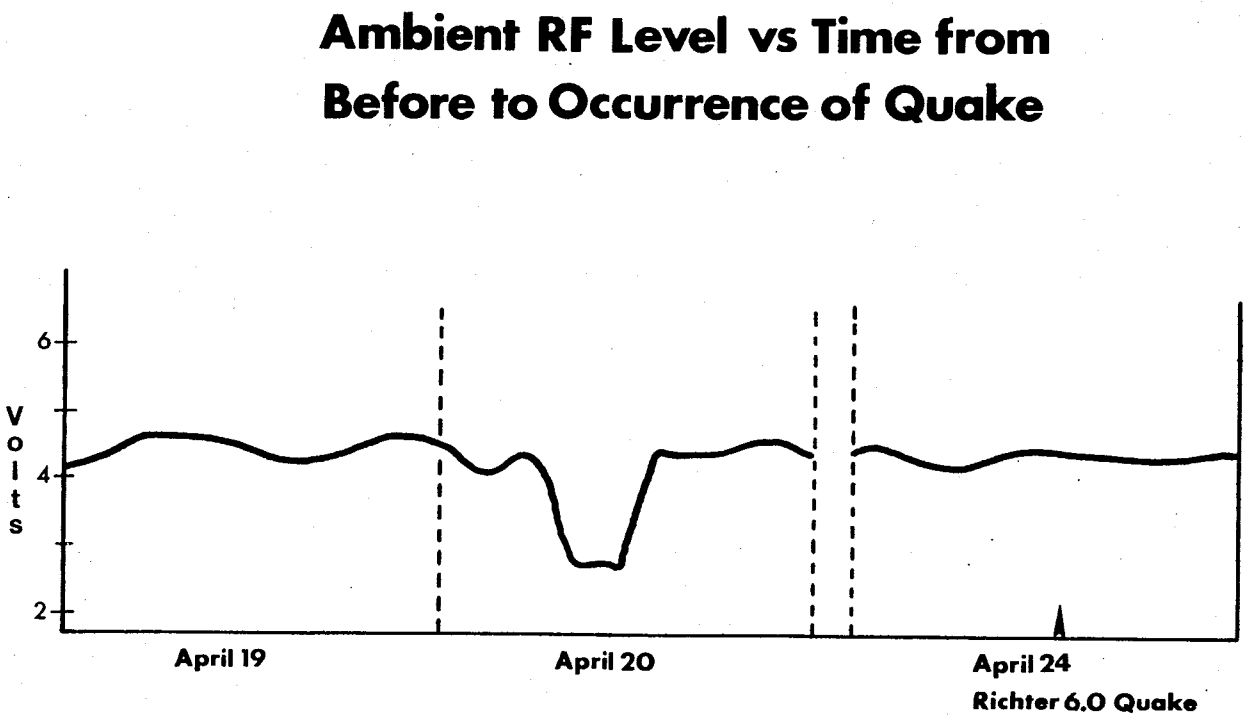
FIG. 2 is a plot of voltage (representing ambient rf level) v. time as measured by the apparatus of FIG. 1.

FIG. 2 illustrates a reproduction of an actual plot of a voltage as a function of time, which voltage was proportional to the ambient RF (radio frequency) level, from the period from before to after a relatively large earthquake. This plot, which is typical of many we have observed before a quake, was made by deriving the voltage with a 30-meter, long-wire monopole antenna (not shown) which was mounted horizontally and which extended over San Francisco (Richardson) Bay easterly from Sausalito, California, 9 meters above sea level. The antenna thus intercepted and converted to an RF voltage the ambient RF energy, mainly from local (San Francisco area) AM radio stations. We rectified and filtered the output of the antenna using one-half of the circuit of FIG. 3 (described below) to provide a DC voltage which was plotted on a conventional ink-on-paper plotter. Note that on the section of the chart for Apr. 19 (1984), which begins at time 0:00 (midnight) and ends at 24:00, the voltage or ambient RF power level at the antenna increased and fell and then increased slightly in the 24-hour period. This wavelike variation typically occurs on a daily basis and is caused by tides: the peaks occurring at low tide when the effective ground plane provided by the water drops and the troughs occurring at high tide when the ground plane rises.

On Apr. 20, from about 8:00 to about 12:00, a sharp and constant-level dip in the ambient rf power occurred, as indicated. The magnitude of this pronounced dip is far greater than the normal tide-caused variations, as is its beginning and ending slope.

Thereafter, from Apr. 20 to Apr. 23, the plot (not shown) continued unremarkably, albeit with a slight variation from normal.

The same occurred on Apr. 24, with the plot actually being generally similar to a normal day. However at 13:15 on Apr. 24, as indicated, a large, Richter magnitude 6.0 quake occured near Hollister, Calif., about 340 km away from the antenna. No change in the plot occurred at this time.

Correllation of this quake with the plot's marked dip of Apr. 20 was made by the repeated observation of dozens of similar dips and subsequent quakes. Pronounced dips were always followed by a quake several days later. Thus we have empirically established causal and theoretical connections between pronounced dips of the type shown and the occurrence of subsequent seismic activity.

FIG. 3—AMBIENT POWER MODULE

Figure 3:
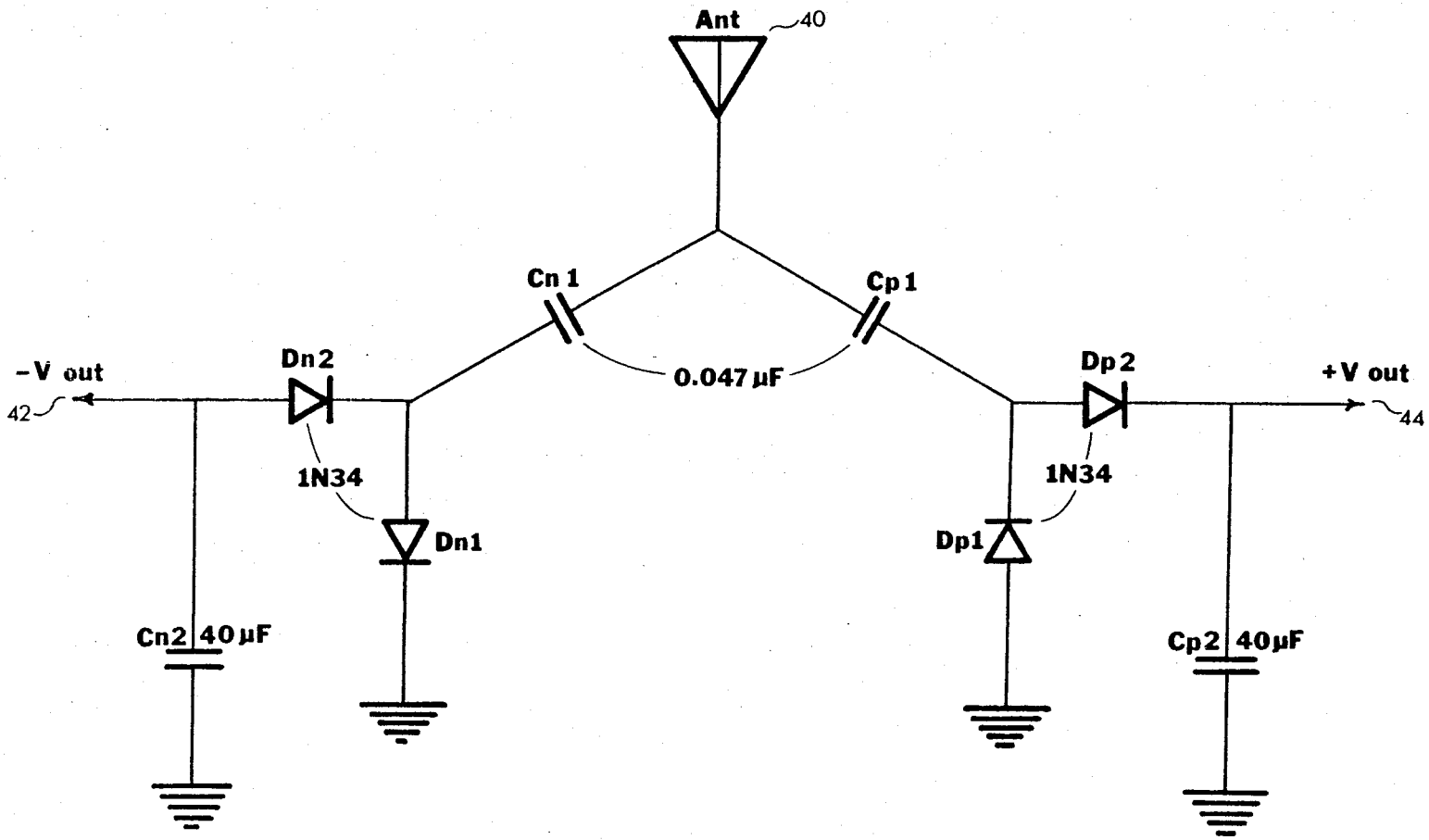
FIG. 3 is a schematic diagram of an ambient power module circuit (used in the SEW apparatus) for producing a DC output voltage proportional to the ambient rf energy

The circuit of FIG. 3 is used to convert the ambient RF energy to a direct voltage which can be used and handled by data processing equipment. Designated an ambient power module (APM), it is connected to an antenna 40, preferably a broadband monopole antenna of the type described in the preceeding section. The distal end of the antenna is free and its proximal end is connected to the circuit via two capacitors Cp1 and Cn1, each being in series with the signal line for coupling and each having a value of 0.047 microfarad. Taking the left or negative side of the circuit first, it comprises two rectifiers (diodes) Dn1 and Dn2 (1N34 type) and a filter capacitor Cn2 (40 microfarads). Rectifier Dn1 is connected in parallel to the signal path and rectifier Dn2 is connected in series, in the wellknown voltage multiplier arrangement. Capacitor Cn2 is connected in parallel across the output of the APM to smooth the rectified output. The right or positive side of the circuit is similar, except for the polarity of the diodes.

In operation, an RF voltage is developed across antenna 40; this voltage is voltage multiplied by the two rectifiers on each side of the circuit. The resultant direct voltages are smoothed or filtered by capacitors Cn1 and Cp2 and are supplied to output terminals 42 and 44. A positive version of this direct voltage is plotted in FIG. 2, as described above.

FIG. 4—BLOCK DIAGRAM OF COMPUTER

Figure 4:
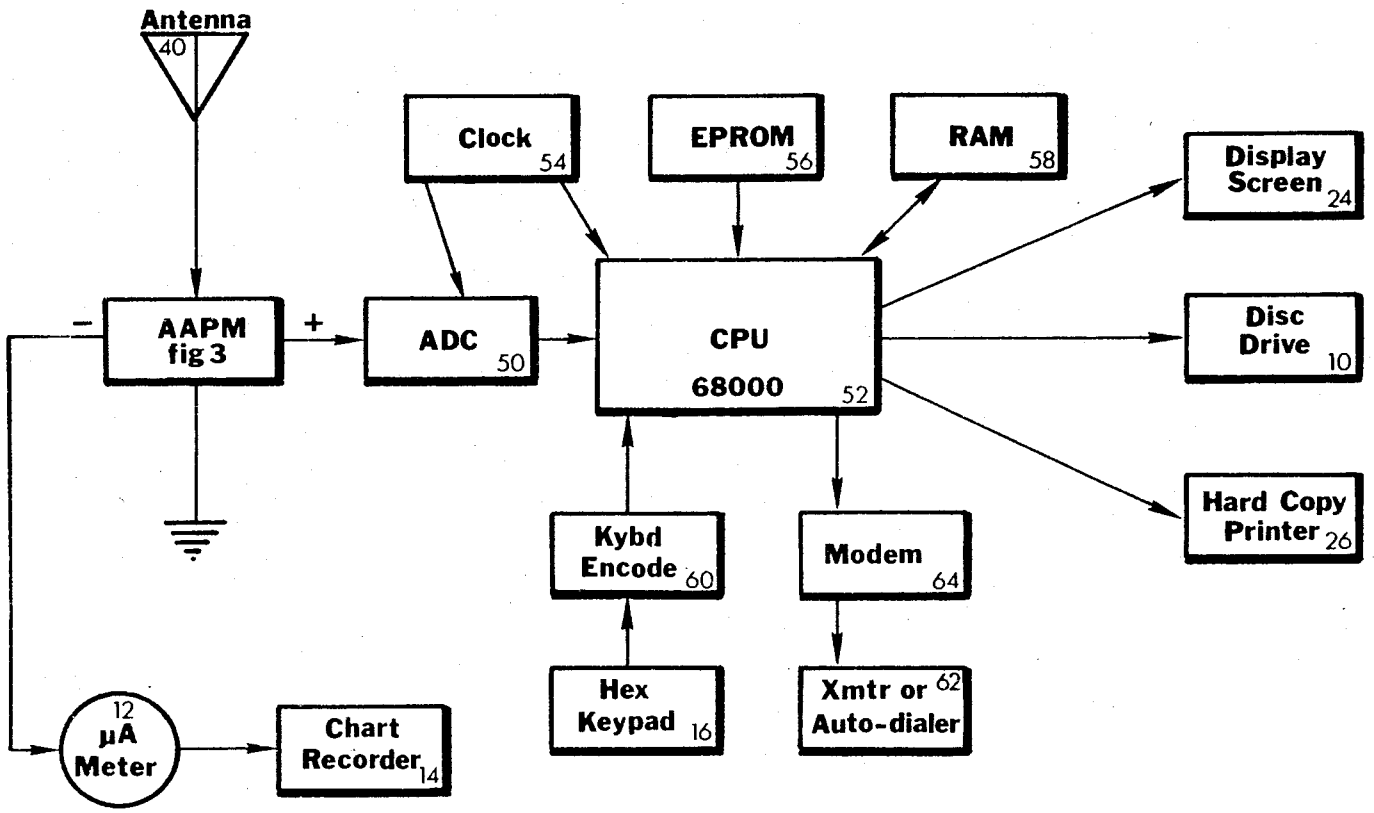
FIG. 4 is a block diagram of a computer in the apparatus of FIG. 1.

A computer for performing the monitoring and alarm functions of the invention and which is provided within the apparatus of FIG. 1 is shown in FIG. 4. The computer receives the positive voltage from the APM (FIG. 3) and processes this, providing an alarm if the voltage dips a predetermined amount from its recent average value.

The computer comprises an analog to digital converter (ADC) 50 which is arranged to convert the positive DC voltage from the AAPM to digital form, preferably in the form of a parallel signal at the output of ADC 50. The digitized voltage from ADC 50 is supplied to a central processing unit 52, which is a type 68000 microprocessor or computer on a chip. CPU 52 and ADC 50 are clocked by a clock 54 in conventional fashion.

CPU 52 operates on instructions from a program contained in an electricallyprogrammed read only memory (EPROM), the program being listed later. CPU 52 temporarily stores data in a read and write memory (RAM) 58. CPU 52 also supplies output data to display screen 24, disc drive 10, and hard-copy printer 26', each of which was already described in conjunction with FIG. 1.

CPU 52 can receive input data manually from hexidecimal keypad 16 (see FIG. 1) via a keyboard encoder 60.

CPU 52 can supply an alarm output to a radio transmitter or automatic telephone dialer 62 via a modem (modulator-demodulator) 64 for connecting the CPU to a phone (not shown).

As also indicated in FIG. 4, the negative output of the AAPM of FIG. 3 is connected to ammeter 12 and chart recorder 14.

FIG. 5—FLOWCHART OF SEISMIC EARLY WARNING SYSTEM

In operation, the system of FIG. 4 operates under control of the program in EPROM 56 in accordance with the flowchart of FIG. 5 as follows:

Startup: Blocks 70 and 72: An initialization and startup sequence is first initiated when the machine is turned on, as indicated by block 70; this sets all registers and counters to zero. The time and data are then set manually (using EPROM 56), as indicated by block 72.

Clock Reading: Blocks 74 and 76: Next, under automatic program control, the machine reads the elapsed time on its clock display register, as indicated by block 74. If the "seconds" register does not indicate the number one (#1), the machine continues to read the clock, as indicated by the "no" output of decision block 76.

Minute Sample: Block 78: When second #1 appears, as it will once per minute, the decision in block 76 will be "yes", so that the machine will take one sample of the rectified, smoothed, and digitized version of the antenna's output, i.e., the output of ADC 50 of FIG. 4, as indicated in block 78. This sample will be taken once per minute, i.e., whenever second #1 is displayed.

Running Average: Block 80: Next, as indicated by block 80, a running average of the samples taken in block 78 is calculated. This is done by accumulating the samples to keep a running total of their values, counting the number of samples accumulated, and dividing the running total by the latest number of samples each time a new sample is taken.

Store Hourly Average: Blocks 82 and 84: Next, as indicated in block 82, a test is made to see if the time display register indicates that minute number one (#1) has come up. If not, the decision is "no" and the clock is read again (block 74). If the decision is "yes", as it will be once per hour, the running average in the accumulator will be stored (block 84) and the accumulator will be cleared or reset to zero.

One Day Test: Block 86 ("No" decision) and Block 94: Next the machine makes a test to see if 24 hours have passed. If not, the machine will not be able to make any valid statistical determinations. Thus it must run at least 24 hours before being operative. Assuming the decision in block 86 is negative (24 hours have not yet elapsed) another test is made (block 94) to see if hour zero is indicated, which will occur once per day. If hour zero is not indicated, (decision in block 94 is negative), the clock will be read again (block 74) in the usual loop.

Calculate SD: Block 86 ("Yes") and Block 88: If a full day has elapsed, so that valid statistics can be calculated ("yes" from block 86), the standard deviation (SD) of the last 24 hourly averages is calculated, as indicated in block 88. This is done once per hour. The calculation is made using the usual SD formula $$SDDEV = SQR([sum(x-X)^2]/n)$$

where SDDEV = SD; SQR = the square root; sum = the sum of; x = the individual hourly averages; X = the mean of the hourly averages; and n = the number of individual hourly averages. Essentially the SD is calculated by taking the mean of all of the hourly averages, taking the difference or deviation of each hourly average from the mean, squaring each deviation, taking the mean of the squared deviations, and then taking the square root of the mean of the squared deviations.

Evaluate SD: Block 90: The SD is then evaluated to see if it is greater than 0.3. This value has been empirically determined to be the level at which a the present apparatus will provide a reasonably positive indication that an earthquake will occur, while neglecting the effects of non-seismic-caused variations. If the SD is less than 0.3, (a "no" output from block 90), this indicates that the last hourly average was not greatly different from the average of the last 24 hourly samples, so that no alarm need be indicated. I.e., the antenna's output did not drop significantly to indicate an impending earthquake. Thereupon the program moves to block 94, where a test is made for the existence of hour zero, as described. If, however the SD exceds 0.3 ("yes" output of block 90), this indicates that the antenna's output has dropped significantly so as to affect the last hourly average, thereby to indicate an impending earthquake.

Alarm: Block 92: In response to the Yes output of block 92, an alarm is triggered (block 94). The alarm may be a bell, the dialing of a telephone to a location where personnel are present if the apparatus is placed at a remote or non-manned location, or the initiation of the further program of the Flowchart of FIG. 6, the alarm trigger sequence. To eliminate the possibility of equipment failure and to provide confirmation from another apparatus at another location, we prefer to provide an alarm only upon confirmation from another apparatus, as discussed in the description of FIG. 6 below.

Make Record: Block 94 ("Yes") and Block 96: If hour zero is being displayed when the operation of block 94 is performed, which occurs once per day at midnight, the operation of block 96 will be performed, i.e., the data in the registers will be stored to disc to create a permanent record and the registers will be cleared to create new data for the next day. However the previous 24 hourly averages are still stored at all times so that a valid SD can be calculated and tested every hour. After the operation of block 96, the clock is read again in accordance with the regular program (block 74).

FIG. 6—ALARM TRIGGER FLOWCHART

Figure 5:
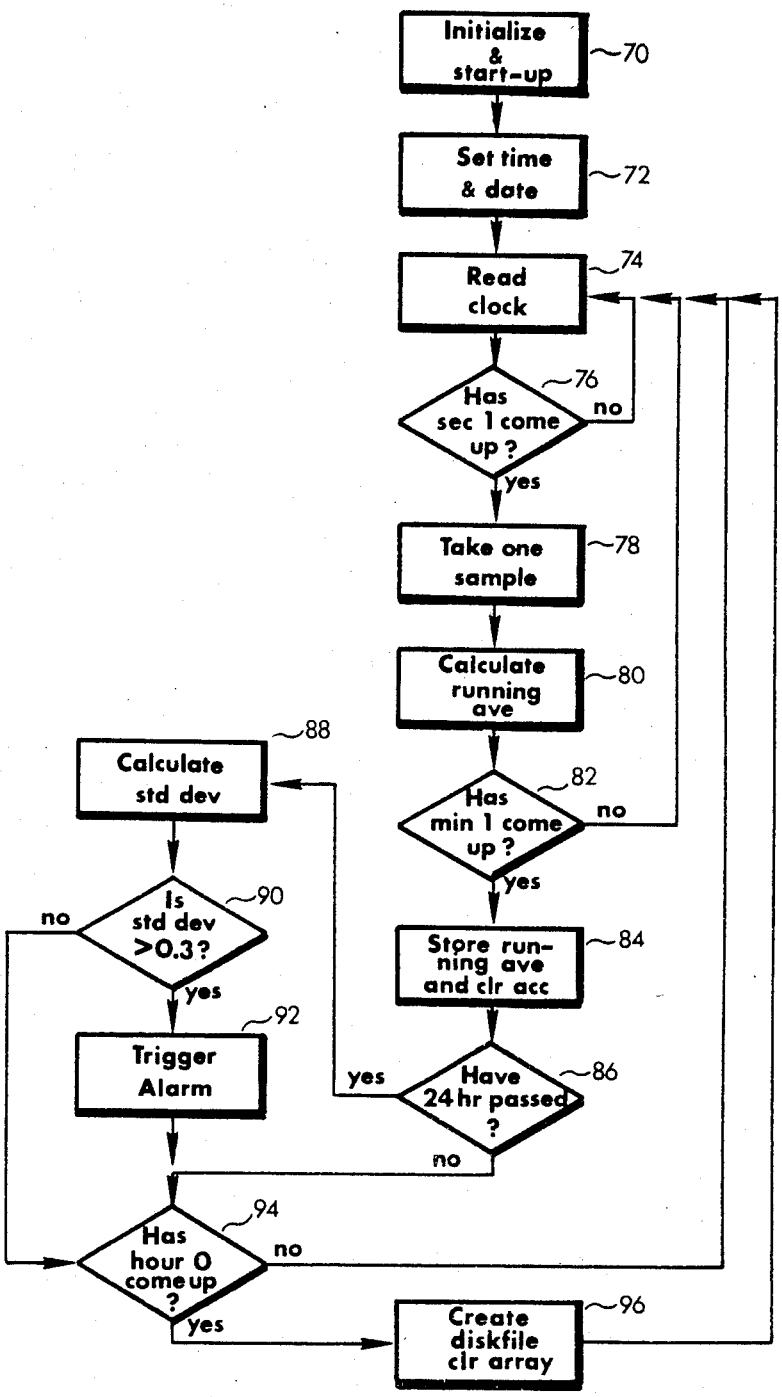
FIG. 5 is a flowchart which depicts the operation of the the SEW system.
Figure 6:
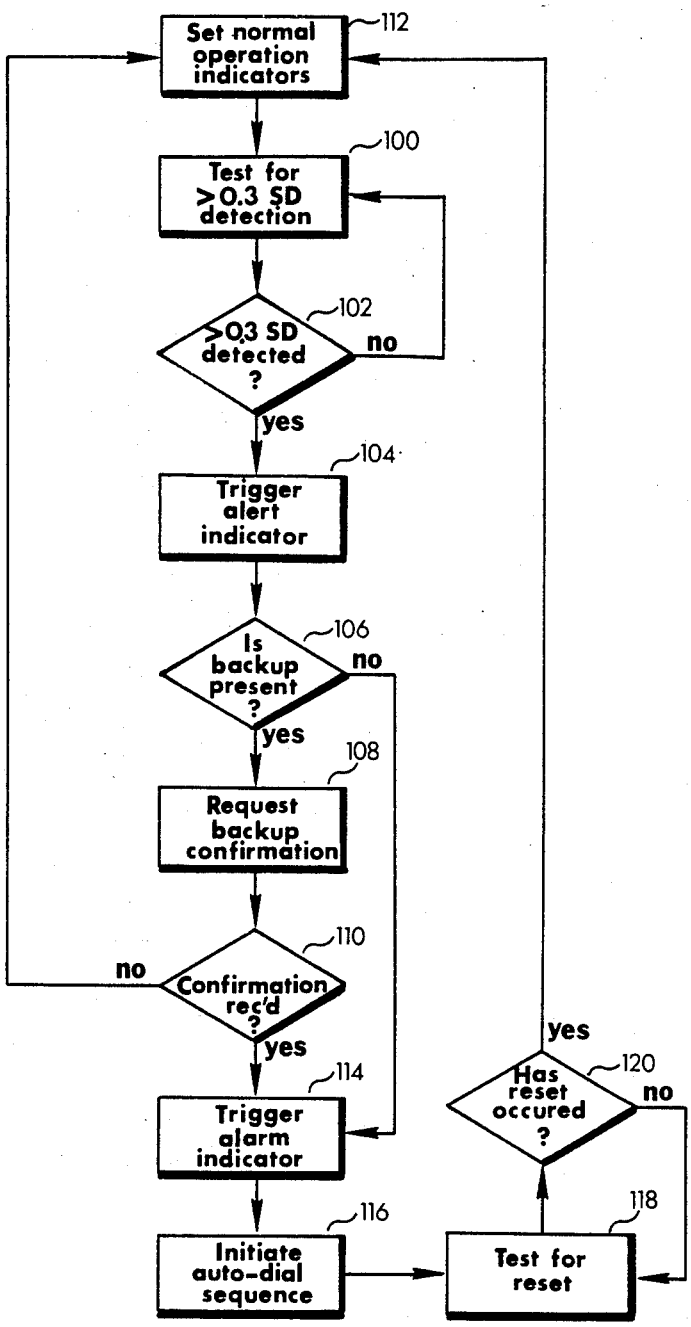
FIG. 6 is a flowchart which depicts the operation of an optional alarm trigger system useable with the SEW apparatus.

The sequence of FIG. 6 is performed when the alarm is triggered in block 92 of FIG. 5 as an optional, but preferred backup confirmation of an impending earthquake. The operations in the backup confirmation system will be described briefly.

Beginning with blocks 100 and 102, the system is continually tested (hourly) for the occurrence of a SD of the hourly averages of greater than 0.3. If the SD is greater than 0.3, the alert indicator (28 of FIG. 1) is triggered (block 104) and the program initiates a test (block 106) to see if a backup apparatus (not shown) is present. If so (yes output of block 106) the backup apparatus is also checked (blocks 108 and 110). If the backup does not indicate an excess SD, the indicators are reset to normal (block 112), but if backup confirmation is received, the alarm indicator (30 of FIG. 1) is triggered per block 114 and a preprogrammed telephone number is dialed and indicator 32 is lit (block 116).

After the alarm condition is manually checked and the system is reset, the output of block 120 will be a "yes" and the system will be reset to normal (block 112). If a valid alarm condition is indicated and confirmed, civil authorities will have time (usually several days) to notify the populace, evacuate the area, or take any other needed precautions, depending on the size of the impending quake as indicated by the size of the standard deviation.

PROGRAMS:

The attached computer programs will perform the calculations and operations above described. These programs are written in the BASIC programming language. Program "RECVOLT.AL" runs continuously and writes the information to disc every 24 hours. Program "GRASTAT.*" is manually run; it reads data from the disc and plots it on the screen or printer, as desired.

While the above description contains many specifications, these should not be construed as limitations on the scope of the invention, but merely as an exemplification of one preferred embodiment thereof. Many other variations are possible. For example, the programming language can be changed, or the calculations and operations can be performed with hard-wired conventional circuitry in lieu of a programmed computer. More than two corroboration receivers can be used, and these can be placed at various locations. In lieu of testing the antenna's output reception of the area's AM stations, a special, decicated transmitter with a special, dedicated frequency and a specially-tuned matching receiver can be used to avoid depedence on stations which are not under the control of the earthquake prediction system and its personnel. The transmitter and the receiver should be spaced apart geographically, preferably by at least several km, so that the ground plane conduction phenemon can operate. Also the transmitted signal can be a specially-coded or modulated signal, or it can be an auxiliary signal of a regular transmitter, e.g., a SSB or SCA signal, together with a matching receiver. In lieu of a test for an excess SD, the apparatus can be arranged to test for a predetermined drop in the value of the antenna output from its immediately previous value or its average value over a predetermined period, such as an hour or day, or for a drop having greater than a predetermined slope. Accordingly the full scope of the invention should be determined by the appended claims and their legal equivalents, and not by the examples given.

"RECVOLT.AL"

8299
Seen of 12-9

```
5 ? ")"
6 HO=0:U=1:G=1
7 DIM P$(100),A$(1):A$=" "
100 DIM B$(3)
110 DIM Z$(15)
115 DIM HAR(24):DIM HA(24):DIM HAL(25)
117 FOR I=1 TO 25:HAL(I)=0:NEXT I
120 POSITION 5,5:? "RECORDING VOLTMETER":POSITION 5,7:? "COPYRIGHT 1984":POSITIO
N 5,9:? "JOE TATE"
125 FOR D=1 TO 1000:NEXT D:? ")"
150 ? "DO YOU WANT TO SEE A FILE?"
```

```
160 INPUT B$
170 IF B$="YES" THEN GOTO 12040
180 IF B$="NO" THEN GOTO 200
200 N=1:J=0:AVG=0:A=0:K=0
205 DIM D$(3),M$(8),DATE$(15),X$(3)
220 FOR R=1 TO 24:HA(R)=0:NEXT R
280 ? ")":POKE 752,1
420 ? "IF DATE IS CORRECT PRESS C"
425 ? "PRESS N FOR NEXT MONTH"
430 READ M$:K=K+1:IF K>13 THEN K=1
432 IF M$<>"RES" THEN 435
433 RESTORE :GOTO 430
435 POSITION 6,12:? M$
440 INPUT X$
445 IF X$="C" THEN 450
448 IF X$="N" THEN 430
449 GOTO 435
450 ? ")"
455 ? "ENTER TODAY'S DATE"
458 INPUT D
459 D$=STR$(D)
460 ? M$;" ";D$
505 ? "DO YOU WANT TO SET THE TIME?";:INPUT X$
510 IF X$="YES" THEN 520
515 GOTO 1050
520 ? ")"
525 ? "HOURS";:INPUT H
530 ? "MINUTES";:INPUT M
535 ? "SECONDS";:INPUT S
540 ? "HIT START TO BEGIN THE TIME"
545 IF PEEK(53279)<>6 THEN 545
550 ? ")"
1010 REM ******PUT CURRENTTIME IN HARWARE REGISTER*****
1011 GRAPHICS 2
1015 POKE 18,0:POKE 19,0:POKE 20,0
1020 T=H*60^3+M*60^2+S*60
1025 POKE 18,INT(T/(256*256))
1030 T=T-(256*256)*(INT(T/(256*256)))
1035 POKE 19,INT(T/256)
1040 T=T-256*(INT(T/256))
1045 POKE 20,INT(T)
1050 ? ")"
1055 TIME=PEEK(20)+PEEK(19)*256+PEEK(18)*256*256
1065 IF TIME>5184000 THEN 1265
1070 TIME=INT(TIME/60+0.5)
1075 SEC=TIME-60*(INT(TIME/60))
1076 R=PEEK(53279):IF R=5 THEN SOUND 0,0,0,0:SOUND 1,0,0,0:U=1
1077 POKE 752,1:IF R=3 THEN G=2:GOTO 12040
1079 IF U=1 THEN POSITION 3,3:? #6;"E.T. ";HO;" HRS.  "
1080 POSITION 14,8:? #6;SEC;":S. "
1082 IF SEC=7 AND G=1 THEN GOSUB 15200:GOTO 14020
1083 IF SEC=8 AND G=0 AND HOURS<>0 THEN GOSUB 13000:GOSUB 13100:FOR D=1 TO 7500:
NEXT D:GOSUB 15200
1085 IF SEC>1 THEN N=1
1086 IF SEC=1 AND N=1 THEN 2020
1095 TIME=INT((TIME-SEC)/60)
1200 MIN=TIME-60*(INT(TIME/60))
1205 HOURS=INT((TIME-MIN)/60)
1210 IF SEC>=60 THEN 1220
1213 IF MIN=1 AND SEC=1 AND HO>24 THEN GOTO 15000
1215 GOTO 1230
1220 MIN=INT(SEC/60)+MIN
1225 SEC=SEC-60*(INT(SEC/60))
1230 IF MIN>=60 THEN 1240
1240 HOURS=INT(MIN/60)+HOURS
1245 MIN=MIN-60*(INT(MIN/60))
1252 IF HOURS>23 THEN HOURS=0
1255 GOTO 1055
1260 ? INT(HOURS+0.5);":";INT(MIN+0.5);":";INT(SEC+0.5):GOTO 1055
1262 ? "LINE1262"
1265 TIME=PEEK(18)*256*256+PEEK(19)*256+PEEK(20)
1270 TIME=TIME-5184000*(INT(TIME/5184000))
1275 POKE 18,INT(TIME/(256*256))
```

```
1280 TIME=TIME-(256*256)*INT(TIME/(256*256))
1285 POKE 19,INT(TIME/256)
1290 TIME=TIME-256*(INT(TIME*256))
1295 IF HOURS>23 THEN H=0:M=0:S=0:GOTO 1015
1300 GOTO 1055
2020 REM ******SAMPLE ROUTINE*****
2022 N=2
2025 LET X=PEEK(625)
2030 IF X>40 THEN POSITION 1,14:? "VOLTAGE BELOW RANGE(LESS THAN 1.8V)"
2035 IF X<3 THEN POSITION 1,10:? "VOLTAGE ABOVE RANGE(ABOVE 7V)"
2040 IF X>26<40 THEN LET V=(40-X)*0.01+1.85
2045 IF X>22<26 THEN LET V=(26-X)*0.062+2
2050 IF X>20<22 THEN LET V=(22-X)*0.125+2.25
2055 IF X>16<20 THEN LET V=(20-X)*0.125+2.5
2060 IF X>13<16 THEN LET V=(16-X)*0.166+3
2065 IF X>11<13 THEN LET V=(13-X)*0.225+3.5
2070 IF X>10<11 THEN LET V=(11-X)*0.4+3.95
2075 IF X>5<10 THEN LET V=(10-X)*0.15+3.25
2080 IF X>8<10 THEN LET V=(10-X)*0.325+4.35
2085 IF X>6<8 THEN LET V=(8-X)*0.5+5.1
2090 IF X>3<6 THEN LET V=(6-X)*0.33+5.9
2095 POKE 77,0
3000 GOSUB 15200
3500 J=J+1
3510 AVG=(A+V)/J
3512 LET A=A+V
3520 ? "SAMPLE #";J;"  RUN AVG ";AVG;M$;D$
3600 HA(HOURS)=AVG
3610 IF MIN<>0 THEN 1055
3612 HAL(25)=AVG
3613 FOR I=1 TO 24:HAL(I)=HAL(I+1):NEXT I
3615 IF MIN=0 THEN A=0:HO=HO+1
3625 J=0
4020 IF HOURS<>0 THEN 1055
4048 REM ****
4050 REM ** CREATE FILENAME-DISKWRITE*****************
4052 REM ****
4053 FOR Q=0 TO 23:HAR(Q)=HA(Q):NEXT Q
4055 DATE$(LEN(DATE$)+1)=M$
4056 DATE$(LEN(DATE$)+1)=D$
4060 OPEN #1,8,0,DATE$
4065 FOR Q=0 TO 23
4070 HAR=HAR(Q)
4072 PRINT #1,HAR:NEXT Q
4075 CLOSE #1
4080 DATE$=""
5000 REM ******DATE ROLLOVER********
5010 IF K=4 OR K=6 OR K=9 OR K=11 THEN DMAX=30:GOTO 5025
5015 IF K=2 THEN DMAX=28:GOTO 5025
5020 DMAX=31
5025 D=VAL(D$)
5030 D=D+1
5035 IF D>DMAX THEN D=1:READ M$:K=K+1
5040 D$=STR$(D)
5050 GOTO 1055
10000 DATA D:JAN.,D:FEB.,D:MAR.,D:APR.,D:MAY.,D:JUN.,D:JUL.,D:AUG.,D:SEP.,D:OCT.
,D:NOV.,D:DEC.
10010 DATA RES
12000 REM READ OUT ROUTINE********
12010 ? "DO YOU WANT TO READ FILE?"
12020 INPUT B$
12030 IF B$="YES" THEN G=2:GOTO 12040
12040 ? "}":GRAPHICS 0:? "ENTER FILE SPEC PLEASE"
12050 INPUT Z$
12055 GOSUB 13000
12056 PLOT 29,75
12057 ? Z$
12060 OPEN #1,4,0,Z$
12070 FOR Q=0 TO 23
12075 FOR X=29 TO 149 STEP 5
12080 LET HAR(Q)=HAR
12085 IF X=149 THEN 12130
12090 INPUT #1,HAR
```

```
12098 LET Y=75-14*(HAR-2):Y=INT(Y)
12100 IF HAR<2 THEN Y=79
12120 DRAWTO X,Y:NEXT X:NEXT Q
12130 CLOSE #1
12140 ? "DO YOU WANT TO SEE ANOTHER FILE?"
12150 INPUT B$
12160 IF B$="YES" THEN 12040
12170 IF B$="NO" THEN ? ")":? "FINISHED"
12175 FOR D=1 TO 200:NEXT D:? ")":GRAPHICS 2:POSITION 3,1:? #6;"SDDEV ";SDDEV:PO
SITION 15,1:? #6;"      "
12177 GOTO 1055
13000 TRAP 13000:? ")":GRAPHICS 7
13010 COLOR 1
13015 PLOT 16,0
13020 DRAWTO 16,79:DRAWTO 159,79
13030 IF G=2 THEN ? "HOUR 0      6      12      18      24"
13035 IF G=0 THEN ? "HOUR  ";HOURS-24;"      ";HOURS-18;"      ";HOURS-12;"      ";
HOURS-6;"      ";HOURS:? "TODAY"
13036 G=1
13040 PLOT 32,4:DRAWTO 36,12:DRAWTO 40,4
13045 PLOT 51,4:DRAWTO 49,6:DRAWTO 49,10:DRAWTO 51,12:DRAWTO 54,12:DRAWTO 57,10:
DRAWTO 57,6:DRAWTO 54,4
13046 DRAWTO 51,4
13050 PLOT 67,4:DRAWTO 67,12:DRAWTO 73,12
13055 PLOT 80,4:DRAWTO 88,4:PLOT 84,4:DRAWTO 84,12
13060 PLOT 96,9:DRAWTO 96,10:DRAWTO 98,12:DRAWTO 101,12:DRAWTO 103,10:DRAWTO 103
,9:DRAWTO 96,6:DRAWTO 96,5
13065 DRAWTO 99,4:DRAWTO 101,4:DRAWTO 103,5:DRAWTO 103,6
13070 PLOT 14,5:DRAWTO 18,5
13072 PLOT 14,19:DRAWTO 18,19
13074 PLOT 14,33:DRAWTO 18,33
13076 PLOT 14,47:DRAWTO 18,47
13078 PLOT 14,61:DRAWTO 18,61
13080 PLOT 14,75:DRAWTO 18,75
13082 PLOT 9,74:DRAWTO 10,73:DRAWTO 11,73:DRAWTO 12,74:DRAWTO 9,77:DRAWTO 12,77
13084 PLOT 9,45:DRAWTO 9,47:DRAWTO 12,47:PLOT 11,45:DRAWTO 11,49
13086 PLOT 12,18:DRAWTO 11,17:DRAWTO 10,17:DRAWTO 9,18:DRAWTO 9,21:DRAWTO 10,22:
DRAWTO 11,22:DRAWTO 12,21
13088 DRAWTO 11,20:DRAWTO 10,20
13089 TRAP 40000
13090 RETURN
13100 FOR Q=1 TO 24:LET X=29+5*(Q-1):LET HAL=HAL(Q)
13110 LET Y=75-14*(HAL-2):Y=INT(Y)
13120 IF HAL<2 THEN Y=79
13122 IF X=29 THEN PLOT X,Y
13125 IF X>29 THEN DRAWTO X,Y
13127 FOR D=1 TO 20:NEXT D:NEXT Q
13130 RETURN
14020 G=0:FOR S=1 TO 7:IF PEEK(53279)=3 THEN 12040
14021 IF S=1 THEN 14120
14022 IF S=2 THEN 14150
14023 IF S=3 THEN 14160
14024 IF S=4 THEN 14170
14025 IF S=5 THEN 14180
14026 IF S=6 THEN 14190
14027 IF S=7 THEN POSITION 1,5:? #6;"                    ":GOTO 1055
14035 LM=LEN(P$)
14040 POSITION 1,5:? #6;"                    "
14060 TRAP 100:FOR I=1 TO 19:POSITION 20-I,5:? #6;P$(1,I):FOR D=1 TO 8:NEXT D:NE
XT I
14070 TRAP 80:FOR I=2 TO LM-19:POSITION 0,5:? #6;P$(I,19+I):FOR D=1 TO 8:NEXT D:
NEXT I
14080 FOR I=0 TO 5:POSITION 0,5:? #6;P$((LM-18)+I,LM);A$:FOR D=1 TO 8:NEXT D:NEX
T I
14090 POSITION 0,5:? #6;A$:GOTO 14200
14100 FOR I=19-LM TO 1 STEP -1:POSITION I,5:? #6;P$(1,LM);A$:FOR D=1 TO 8:NEXT D
:NEXT I
14110 FOR I=1 TO LM:POSITION 0,5:? #6;P$(I,LM):FOR D=1 TO 8:NEXT D:NEXT I:GOTO 1
4090
14120 P$="THIS ATARI COMPUTER IS BEING USED AS A RECORDING VOLTMETER":GOTO 14035
14150 P$="VOLTAGE TO BE MEASURED AND RECORDED IS BROUGHT IN THROUGH THE JOYSTICK
 PORT":GOTO 14035
14160 P$="AN ANTENNA ON THE ROOF OF THE BUILDING PROVIDES A SOURCE OF FLUCTUATIN
```

```
G VOLTAGE":GOTO 14035
14170 P$="A RECORD OF THE VARIATIONS IS SENT TO THE DISK DRIVE":GOTO 14035
14180 P$="THIS ALLOWS YOU TO SEE GRAPHS OF HOURLY VOLTAGE CHANGES FOR PREVIOUS D
AYS":GOTO 14035
14190 P$="TO SEE PREVIOUS RECORDS PRESS OPTION UNTIL SCREEN CHANGES":GOTO 14035
14200 NEXT S
15000 REM ---CALC MEAN & STD DEV---
15005 SUM=0:SDDEV=0:DFF=0
15010 FOR I=1 TO 24
15020 SUM=SUM+HAL(I):NEXT I
15030 MEAN=SUM/24
15040 FOR I=1 TO 24
15050 DFF=DFF+(HAL(I)-MEAN)^2:NEXT I
15060 SDDEV=SQR(DFF/(23))
15065 POSITION 3,1:? #6;"SDDEV ";SDDEV:POSITION 15,1:? #6;"      "
15070 IF SDDEV>0.5 THEN GOSUB 15100
15080 GOTO 1055
15100 REM -----ALARM TONE-----
15105 POSITION 1,3:? #6;"A.T. ";HOURS;" ";M$;D$:U=0
15110 FOR TONE=1 TO 30
15120 SOUND 0,120,10,10
15125 SOUND 1,85,10,10
15130 FOR D=1 TO 20:NEXT D
15140 SOUND 0,0,0,0
15145 SOUND 1,0,0,0
15150 FOR D=1 TO 10:NEXT D
15160 NEXT TONE
15165 SOUND 0,120,10,10
15166 SOUND 1,85,10,10
15170 RETURN
15200 GRAPHICS 2:POSITION 3,1:? #6;"SDDEV ";SDDEV:POSITION 15,1:? #6;"        "
15210 POSITION 3,3:? #6;"E.T. ";HO;" HRS.  "
15215 POSITION 5,7:? #6;V;" VOLTS  "
15220 POSITION 1,8:? #6;HOURS;":HRS ";MIN;":M. "
15225 ? "SAMPLE #";J;" RUN AVG ";AVG:M$;D$
15230 RETURN
```

"GRASTAT.*"

```
90 DIM HAR(24)
95 DIM Z$(10)
100 GRAPHICS 0:CLOSE #1:OPEN #1,4,0,"K:":POKE 752,1:SETCOLOR 2,0,0
110 DIM SA(300)
120 REM GENERAL INSTRUCTIONS
130 POSITION 15,6:? "STATISTICS":POSITION 18,10:? "FOR":POSITION 11,14:? "NON-ST
ATISTICIANS"
140 FOR K=1 TO 300:SA(K)=0:NEXT K
150 ? ")":POSITION 14,3:? "THIS PROGRAM":POSITION 13,4:? "CALCULATES THE":POSITI
ON 12,5:? "FOLLOWING VALUES"
160 POSITION 9,6:? "FROM THE DATA YOU INPUT:"
170 POSITION 14,9:? "1. MEAN":POSITION 14,11:? "2. STANDARD":POSITION 17,12:? "D
EVIATION"
180 POSITION 14,14:? "4. RANGE"
190 POSITION 9,20:? "PRESS 'C' TO CONTINUE"
200 GET #1,A:IF A<>67 THEN 200
210 REM REQUEST INSTRUCTIONS
220 SUM=0:MEAN=0:DFF=0:SDDEV=0:RG=0
230 ? ")":POSITION 5,12:? "Do you need instructions (y/n)?"
240 GOSUB 1350
250 IF A=89 THEN GOSUB 830
260 REM DATA ENTRY
265 CLOSE #1
270 ? ")":POSITION 9,11:? "Enter Filedate:   ":INPUT Z$:N=24
280 IF N>300 OR N<1 THEN FOR I=28 TO 38:POSITION I,11:? CHR$(32):NEXT I:GOTO 270
290 FOR Q=1 TO 2
300 OPEN #1,4,0,Z$
310 FOR I=1 TO 24
320 LET HAR(I)=HAR
330 INPUT #1;HAR
331 NEXT I:CLOSE #1:NEXT Q
335 FOR I=1 TO 24:SA(I)=HAR(I):NEXT I
336 SA(I)=SA
340 FOR J=22 TO 38:POSITION J,12:? CHR$(32):NEXT J
341 OPEN #1,4,0,"K:"
```

```
350 REM ERROR CORRECTION REQUEST
360 ? ")":POSITION 3,12:? "Wish to make any corrections (y/n)?"
370 GOSUB 1350
380 IF A=89 THEN GOTO 1120
390 REM CALCULATION OF MEAN AND STD. DEVIATION
400 ? ")":POSITION 15,12:? "PLEASE WAIT":POSITION 6,14:? "STATISTICS BEING CALCU
LATED"
410 FOR I=1 TO N
420 SUM=SUM+SA(I):NEXT I
430 MEAN=SUM/N
440 FOR I=1 TO N
450 DFF=DFF+(SA(I)-MEAN)^2:NEXT I
460 SDDEV=SQR(DFF/(N-1))
470 REM SORTING THE DATA
480 FL=0
490 FOR I=1 TO N-1
500 IF SA(I)<=SA(I+1) THEN 550
510 Q=SA(I)
520 SA(I)=SA(I+1)
530 SA(I+1)=Q
540 FL=1
550 NEXT I
560 IF FL=1 THEN 480
570 REM CALCULATION OF RANGE
580 RG=SA(N)-SA(1)
590 LR=SA(1):HR=SA(N)
600 REM CALCULATION OF MEDIAN
610 IF N/2<>INT(N/2) THEN 650
620 IF SA(N/2)=SA(N/2+1) THEN MDD=SA(N/2)
630 IF SA(N/2)<>SA(N/2+1) THEN MDD=(SA(N/2)+SA(N/2+1))/2
640 GOTO 670
650 MDD=SA(INT(N/2+1))
660 REM PRINT RESULT TO SCREEN
670 ? ")":POSITION 10,2:? "CALCULATION RESULTS":POSITION 9,4:? "*****  ";Z$;" **
***"
680 POSITION 4,6:? "SAMPLE SIZE:":POSITION 26,6:? N
690 POSITION 4,8:? "MEAN(X BAR)":POSITION 26,8:? INT(MEAN*10000+0.5)/10000
700 POSITION 4,10:? "STD. DEVIATION":POSITION 26,10:? INT(SDDEV*10000+0.5)/10000
710 POSITION 4,12:? "MEDIAN":POSITION 26,12:? MDD
720 POSITION 4,14:? "RANGE":POSITION 26,14:? RG
730 POSITION 4,16:? "LOWEST SAMPLE VALUE":POSITION 26,16:? LR
740 POSITION 4,18:? "HIGHEST SAMPLE VALUE":POSITION 26,18:? HR
750 POSITION 13,22:? "PRESS ANY KEY"
760 GET #1,A
770 REM REQUEST TO CONTINUE OR END
775 GOSUB 1400
780 ? ")":POSITION 4,12:? "Wish to Process more data (y/n)?"
790 GOSUB 1350
800 IF A=78 THEN GRAPHICS 0:END
810 FOR I=1 TO N:SA(I)=0:NEXT I:GOTO 220
820 REM INSTRUCTION SUBROUTINE
830 ? ")":POSITION 5,5:? "The maximum number of enties is   300, while the mini
mun number is 2."
840 POSITION 5,9:? "The mean is the arithmatic average of the numbers you enter.
"
850 POSITION 5,13:? "THE STANDARD DEVIATION is a measure of how widely your numb
ers spread     from the average."
860 POSITION 10,21:? "Press a key for more."
870 GET #1,A
880 ? ")":POSITION 6,3:? "Since the values you enter tend to form a bell curve(N
ormal Dist.), the Std. Deviation"
890 POSITION 17,5:? " is a measure of the    area under the bell curve."
900 POSITION 3,9:? "No of Std.Dev.(+/-)":POSITION 3,10:? "----------------------
-"
910 POSITION 29,9:? "% Area":POSITION 29,10:? "-------"
920 POSITION 4,12:? "(+/-) 1 Std. Dev.":POSITION 31,12:? "68.3"
930 POSITION 4,14:? "(+/-) 2 Std. Dev.":POSITION 31,14:? "95.5"
940 POSITION 4,16:? "(+/-) 3 Std. Dev.":POSITION 31,16:? "99.7"
950 POSITION 4,18:? "(+/-) 4 Std. Dev.":POSITION 31,18:? "99.9"
960 POSITION 10,21:? "Press a key for more"
970 GET #1,A
980 ? ")":POSITION 4,5:? "The MEDIAN is the value at the     mid-Point of your d
ata."
```

```
990 POSITION 4,10:? "The RANGE is the difference between your lowest data value"
1000 POSITION 25,11:? "and the highest. The range is a quick-and-dirty"
1010 ? "estimate of the spread. The standard  deviation is more reliable tha the
    spread."
1020 POSITION 10,20:? "Press 'S' to start"
1030 GET #1,A:IF A<>83 THEN 1030
1040 RETURN
1050 REM DISPLAY CORRECTION OPTIONS
1060 ? ")":POSITION 1,23:? "C=CHANGE DATA   N=NEXT TABLE    Q=QUIT":RETURN
1070 GET #1,A:IF A<>67 AND A<>78 AND A<>81 THEN 1070
1080 IF A=78 THEN 1280
1090 IF A=81 THEN 390
1100 ? ")"
1110 REM ERROR CORRECTION SUBROUTINE
1120 ? ")":POSITION 3,12:? "Remember incorrect sample # (y/n)?"
1130 GOSUB 1350
1140 IF A=78 THEN 1230
1150 ? ")":POSITION 7,9:? "What is the sample #";:INPUT EN
1160 IF EN>N OR EN<1 OR EN<>INT(EN) THEN 1150
1170 POSITION 7,11:? "Sample ";EN:POSITION 22,11:? "Value ";SA(EN)
1180 POSITION 7,13:? "Enter your new value":POSITION 7,14:INPUT C:SA(EN)=C:HAR(E
N)=C
1190 POSITION 7,19:? "Any more changes (y/n)?"
1200 GOSUB 1350
1210 IF A=89 THEN 1120
1220 GOTO 400
1230 GOSUB 1060:POSITION 5,2:? "These are the first ten values:"
1240 POSITION 11,5:? "ENTRY":POSITION 22,5:? " VALUE"
1250 FOR K=1 TO 10
1260 POSITION 12,K+7:? K:POSITION 24,K+7:? SA(K):NEXT K
1270 GOTO 1070
1280 POSITION 5,2:? "These are the next ten values:     ":IF K<=300 THEN GOSUB 1
340
1290 CT=8:FOR K=K TO K+9
1300 IF K>300 THEN K=K+9:NEXT K:GOTO 400
1310 POSITION 12,CT:? K:POSITION 24,CT:? SA(K)
1320 CT=CT+1:NEXT K
1330 GOTO 1070
1340 FOR J=1 TO 10:POSITION 12,J+7:? "    ":POSITION 24,J+7:? "                    ":
NEXT J:RETURN
1350 GET #1,A:IF A<>89 AND A<>78 THEN 1350
1360 RETURN
1400 ? "DO YOU WISH TO PRINT RESULTS?"
1410 GET #1,A:IF A<>89 AND A<>78 THEN 1410
1420 IF A=78 THEN RETURN
1430 LPRINT :LPRINT :LPRINT "24 HOUR VOLTAGE STATISTICS FOR ";Z$:LPRINT
1440 LPRINT "SAMPLE SIZE...............";N:LPRINT
1445 LPRINT "MEAN(X BAR)...............";INT(MEAN*10000+0.5)/10000:LPRINT
1450 LPRINT "STD.DEVIATION.............";INT(SDDEV*10000+0.5)/10000:LPRINT
1455 LPRINT "MEDIAN....................";MDD:LPRINT
1460 LPRINT "RANGE.....................";RG:LPRINT
1465 LPRINT "LOWEST SAMPLE VALUE.......";LR:LPRINT
1470 LPRINT "HIGEST SAMPLE VALUE.......";HR:LPRINT
1480 ? "DO YOU WANT TO PRINT GRAPHICS?"
1490 GET #1,A:IF A<>89 AND A<>78 THEN 1490
1495 IF A=78 THEN RETURN
1500 GOTO 11960
11960 DIM B$(3)
11990 DIM D$(3),M$(8),DATE$(15),X$(3)
12000 REM ***READ OUT ROUTINE******
12055 GOSUB 13000
12057 CLOSE #1
12060 X=58
12062 U=HAR(1)
12065 FOR I=1 TO 23:HAR(I)=HAR(I+1):NEXT I
12066 HAR(24)=U
12070 FOR I=1 TO 24
12080 LET HAR=HAR(I)
12098 LET Y=150-28*(HAR-2):Y=INT(Y)
12100 IF HAR<2 THEN Y=158
12115 IF X=58 THEN PLOT 58,Y
12120 IF X>58 THEN DRAWTO X,Y
12122 X=X+10
12125 NEXT I
```

```
12130 CLOSE #1
12132 GOSUB 14000:GOTO 13990
12140 ? "DO YOU WANT TO SEE ANOTHER FILE?"
12150 INPUT B$
12160 IF B$="YES" THEN 12040
12170 IF B$="NO" THEN ? ")":? "FINISHED"
12175 FOR D=1 TO 1000:NEXT D:GOTO 12000
13000 ? ")":GRAPHICS 8+16
13010 COLOR 1
13015 PLOT 32,0
13020 DRAWTO 32,158:DRAWTO 318,158
13040 PLOT 64,8:DRAWTO 72,24:DRAWTO 80,8
13045 PLOT 102,8:DRAWTO 98,12:DRAWTO 98,20:DRAWTO 102,24:DRAWTO 108,24:DRAWTO 11
4,20:DRAWTO 114,12:DRAWTO 108,8
13046 DRAWTO 102,8
13050 PLOT 134,8:DRAWTO 134,24:DRAWTO 146,24
13055 PLOT 160,8:DRAWTO 176,8:PLOT 168,8:DRAWTO 168,24
13060 PLOT 192,18:DRAWTO 192,20:DRAWTO 196,24:DRAWTO 202,24:DRAWTO 206,20:DRAWTO
 206,18:DRAWTO 192,12:DRAWTO 192,10
13065 DRAWTO 198,8:DRAWTO 202,8:DRAWTO 206,10:DRAWTO 206,12
13070 PLOT 28,10:DRAWTO 36,10
13072 PLOT 28,38:DRAWTO 36,38
13074 PLOT 28,66:DRAWTO 36,66
13076 PLOT 28,94:DRAWTO 36,94
13078 PLOT 28,122:DRAWTO 36,122
13080 PLOT 28,150:DRAWTO 36,150
13082 PLOT 18,148:DRAWTO 20,146:DRAWTO 22,146:DRAWTO 24,148:DRAWTO 18,154:DRAWTO
 24,154
13084 PLOT 18,90:DRAWTO 18,94:DRAWTO 24,94:PLOT 22,90:DRAWTO 22,98
13086 PLOT 24,36:DRAWTO 22,34:DRAWTO 20,34:DRAWTO 18,36:DRAWTO 18,42:DRAWTO 20,4
4:DRAWTO 22,44:DRAWTO 24,42
13088 DRAWTO 22,40:DRAWTO 20,40
13090 PLOT 16,165:DRAWTO 16,169:PLOT 16,167:DRAWTO 19,167:PLOT 19,165:DRAWTO 19,
169:PLOT 24,165
13092 DRAWTO 23,166:DRAWTO 23,168:DRAWTO 24,169:DRAWTO 25,169:DRAWTO 26,168:DRAW
TO 26,166:DRAWTO 25,165
13094 DRAWTO 24,165
13096 PLOT 29,165:DRAWTO 29,168:DRAWTO 30,169:DRAWTO 31,169:DRAWTO 32,168:DRAWTO
 32,165
13098 PLOT 36,165:DRAWTO 36,169:PLOT 37,166:DRAWTO 38,165:DRAWTO 39,165
13100 PLOT 45,165:DRAWTO 43,165:DRAWTO 42,166:DRAWTO 43,167:DRAWTO 44,167:DRAWTO
 45,168:DRAWTO 44,169
13102 DRAWTO 42,169
13104 PLOT 57,165:DRAWTO 56,166:DRAWTO 56,168:DRAWTO 57,169:DRAWTO 58,169:DRAWTO
 59,168:DRAWTO 59,166
13106 DRAWTO 58,165:DRAWTO 57,165
13108 PLOT 107,165:DRAWTO 105,165:DRAWTO 104,166:DRAWTO 104,168:DRAWTO 105,169:D
RAWTO 106,169:DRAWTO 107,168
13110 DRAWTO 106,167:DRAWTO 105,167
13112 PLOT 163,165:DRAWTO 163,169
13114 PLOT 166,166:DRAWTO 167,165:DRAWTO 168,165:DRAWTO 169,166:DRAWTO 166,169:D
RAWTO 169,169
13116 PLOT 220,165:DRAWTO 220,169
13118 PLOT 224,165:DRAWTO 223,166:DRAWTO 224,167:DRAWTO 223,168:DRAWTO 224,169:D
RAWTO 225,169:DRAWTO 226,168
13120 DRAWTO 225,167:DRAWTO 226,166:DRAWTO 225,165
13122 PLOT 275,166:DRAWTO 276,165:DRAWTO 277,165:DRAWTO 278,166:DRAWTO 275,169:D
RAWTO 278,169
13124 PLOT 281,165:DRAWTO 281,167:DRAWTO 284,167:PLOT 283,165:DRAWTO 283,169
13500 RETURN
13990 GOSUB 15000
14000 TRAP 14030:RESTORE :READ N:DIM P$(N)
14020 FOR I=0 TO N-1
14030 READ J
14040 POKE ADR(P$)+I,J
14050 NEXT I
14065 READ I
14067 RETURN
14989 REM
14990 REM
14991 REM *** DUMP PICTURE ON SCREEN
14992 REM
14993 REM ***
```

```
14994 REM
14995 REM ***
14996 REM
14997 REM ***
14998 REM
14999 REM
15000 X=USR(ADR(P$),INV)
15010 IF X THEN GRAPHICS 0:PRINT "DUMP ERROR -":END
15020 RETURN
15030 REM
19990 REM
19991 REM
19992 REM
19993 REM
19994 REM
19995 REM
19996 REM
19997 REM
20000 DATA 566
20010 DATA 169,96,133,7,32,7,0,186,202,189,0,1,56,233,6,133
20020 DATA 204,232,189,0,1,233,0,133,205,160,195,177,204,201,240,144
20030 DATA 123,165,204,24,105,97,133,206,165,205,105,0,133,207,160,0
20040 DATA 177,206,200,17,206,240,101,136,177,206,24,101,204,133,208,200
20050 DATA 177,206,101,205,133,209,140,2,6,160,1,177,208,24,101,204
20060 DATA 145,208,200,177,208,41,15,101,205,145,208,172,2,6,200,208
20070 DATA 207,193,0,203,0,209,0,225,0,230,0,248,0,255,0,68
20080 DATA 1,91,1,114,1,119,1,129,1,145,1,149,1,155,1,193
20090 DATA 1,205,1,211,1,217,1,10,2,42,2,0,0,170,240,5
20100 DATA 104,104,202,208,251,169,132,133,212,134,213,96,104,201,1,208
20110 DATA 236,104,141,7,6,104,13,7,6,240,4,169,0,240,2,169
20120 DATA 255,141,3,6,186,142,0,6,169,0,133,212,133,213,141,5
20130 DATA 6,32,122,241,162,48,169,3,157,66,3,173,43,242,157,68
20140 DATA 3,173,44,242,157,69,3,169,8,157,74,3,169,0,157,75
20150 DATA 3,32,17,242,169,10,32,230,241,166,88,164,89,134,204,132
20160 DATA 205,169,28,141,7,6,160,0,185,48,242,201,255,240,6,32
20170 DATA 230,241,200,208,243,160,0,165,204,72,165,205,72,162,0,177
20180 DATA 204,157,9,6,165,204,24,105,40,133,204,144,2,230,205,232
20190 DATA 224,8,144,235,138,72,152,72,169,8,141,8,6,162,0,138
20200 DATA 30,9,6,106,232,224,8,144,247,77,3,6,174,7,6,202
20210 DATA 208,2,41,7,32,162,241,206,8,6,208,225,104,168,104,170
20220 DATA 104,133,205,104,133,204,200,192,40,144,172,32,132,241,165,204
20230 DATA 24,105,24,133,204,165,205,105,1,133,205,206,7,6,208,134
20240 DATA 169,15,32,230,241,169,155,32,230,241,162,48,169,12,157,66
20250 DATA 3,76,17,242,173,5,6,240,21,72,169,0,141,5,6,169
20260 DATA 28,32,230,241,104,32,230,241,173,6,6,32,230,241,169,10
20270 DATA 208,68,9,128,174,5,6,240,52,205,6,6,208,8,238,5
20280 DATA 6,208,50,206,5,6,72,173,5,6,201,3,176,13,173,6
20290 DATA 6,32,230,241,206,5,6,208,245,240,17,169,28,32,230,241
20300 DATA 173,5,6,32,230,241,173,6,6,32,230,241,104,141,6,6
20310 DATA 169,1,141,5,6,96,140,2,6,141,4,6,162,48,169,11
20320 DATA 157,66,3,169,1,157,72,3,169,0,157,73,3,157,75,3
20330 DATA 169,4,157,68,3,169,6,157,69,3,32,17,242,172,2,6
20340 DATA 96,32,86,228,162,48,189,67,3,16,245,133,212,174,0,6
20350 DATA 154,162,48,169,12,157,66,3,76,86,228,45,242,80,58,155
20360 DATA 8,27,16,0,74,255,63093
25000 LPRINT :LPRINT :LPRINT "          ";Z$
```

We claim:

1. A method for providing an early warning of the future occurrence of an earthquake, comprising the following steps:

(a) measuring the field strength of at least one broadcast radio frequency signal at a location separated from the place of transmission of said signal, and (b) providing a humanly-sensible indication if the strength of said signal decreases beyond a predetermined amount from a previous value thereof.

2. The method of claim 1 wherein said measuring is done on a broadband basis so as to measure the strength of a plurality of radio signals.

3. The method of claim 1 wherein said measuring is performed by rectifying and filtering said radio frequency to provide a direct current voltage and wherein said indication is provided in response to a predetermined drop in the value of said voltage.

4. The method of claim 1 wherein said indication is provided if the strength of said signal decreases a predetermined amount from an average value thereof.

5. The method of claim 4 wherein the value of said signal is periodically sampled for a predetermined period, a standard deviation of the resultant samples is calculated, and said indication is provided if said standard deviation exceeds a predetermined value.

6. The method of claim 4 wherein said signal is sampled once per minute, the resultant minute samples are averaged each hour, and the resultant hourly averages are tested to determine if the latest hourly average has deviated from previous hourly averages beyond a predetermined amount.

7. The method of claim 1 wherein said indication is provided only if at least wo separated receivers detect said predetermined drop in the strength of said signal.

8. The method of claim 1 wherein a visible record of said signal's field strength is plotted as it is measured.

9. The method of claim 1 wherein the strength of a plurality of broadcast signals are measured by rectifying and filtering said signals to provide a direct current voltage, said direct current voltage is periodically sampled, the resultant samples are averaged periodically to provide periodic averages, the standard deviation of said periodic averages is calculated, and said indication is provided if the value of said standard deviation exceeds a predetermined value.

10. A system for providing an early warning of the future occurrence of an earthquake, comprising:

(a) means for measuring the field strength of a least one broadcast radiofrequency signal, said means being arranged to measure said field strength at a location separated from the place of transmission of said signal, and (b) means responsive to the measured strength of said signal for providing a humanly-sensible indication if said measured field strength decreases beyond a predetermined amount from an average value thereof.

11. The system of claim 10 wherein said means for measuring comprises a broadband receiver for measuring the strength of a plurality of radio signals.

12. The system of claim 10 wherein said means for measuring comprises means for rectifying and filtering said radio frequency signal to provide a direct current voltage and wherein means for providing said indication is arranged to do so in response to a predetermined drop in the value of said voltage.

13. The system of claim 11 wherein said means for providing said indication is arranged to do so if the strength of said signal decreases a predetermined amount from an average value thereof.

14. The system of claim 13 wherein said means for measuring comprises means for periodically sampling the value of said radio signal for a predetermined period, and wherein said means for providing said indication is arranged to calculate the standard deviation of the resultant samples and to provide said indication if said standard deviation exceeds a predetermined value.

15. The system of claim 13 wherein said means for periodically sampling said signal is arranged to take a sample once per minute and to average the resultant minute samples each hour, and wherein said means for providing said indication is arranged to do so by testing the resultant hourly averages to determine if the latest hourly average has deviated from previous hourly averages beyond a predetermined amount.

16. The system of claim 10 wherein said means for providing said indication is arranged to do so only in response to the detection of a predetermined drop in the strength of said signal by two separated receivers.

17. The system of claim 10 further including means for making a visible record of said signal's field strength as it is measured.

18. The system of claim 10 wherein said means for measuring includes means for measuring the strength of a plurality of broadcast signals by rectifying and filtering said signals to provide a direct current voltage, means for periodically sampling said direct current voltage, means for averaging the resultant samples periodically to provide periodic averages, and wherein said means for providing said indication includes means for calculating the standard deviation of said periodic averages, and providing said indication if the value of said standard deviation exceeds a predetermined value.

19. The system of claim 10 wherein said means for measuring and providing said indication comprises a broadband receiver arranged to provide a direct current output voltage, an analog to digital converter, and a programmed computer arranged to receive the outpt of said converter.

20. The system of claim 19 further including means for periodically storing received field strength values and providing a visible plot of the continuous value of said field strength.

* * * * *

UNITED STATES PATENT AND TRADEMARK OFFICE

CERTIFICATE OF CORRECTION

PATENT NO. : 4,628,299

DATED : 1986 Dec 9

INVENTOR(S) : J. B. Tate and D. E. Brown

It is certified that error appears in the above-identified patent and that said Letters Patent are hereby corrected as shown below:

Col. 1, line 6, change "fugure" to --future--.

Col. 3, line 24, change "ouo" to --out--.

Col. 8, line 25, change "specifications" to --"specificities--.

Col 8, near bottom, delete handwriting at top of program listing reading "8299 Issue of 12-9".

Signed and Sealed this

Tenth Day of March, 1987

*Attest:*

*Attesting Officer*

DONALD J. QUIGG

*Commissioner of Patents and Trademarks*